US010473115B2

(12) United States Patent
Kreienkamp et al.

(10) Patent No.: US 10,473,115 B2
(45) Date of Patent: Nov. 12, 2019

(54) DIFFUSER FOR A RADIAL COMPRESSOR

(71) Applicant: ABB Turbo Systems AG, Baden (CH)

(72) Inventors: Christian Kreienkamp, Bad Sackingen (DE); Armin Reichl, Kussaberg (DE); Daniel Rusch, Wettingen (CH)

(73) Assignee: ABB Turbo Systems AG, Baden (CH)

( * ) Notice: Subject to any disclaimer, the term of this patent is extended or adjusted under 35 U.S.C. 154(b) by 184 days.

(21) Appl. No.: 15/630,938

(22) Filed: Jun. 22, 2017

(65) Prior Publication Data

US 2017/0284401 A1 Oct. 5, 2017

Related U.S. Application Data

(63) Continuation of application No. PCT/EP2015/081037, filed on Dec. 22, 2015.

(30) Foreign Application Priority Data

Dec. 23, 2014 (DE) ..... 10 2014 119 558
Dec. 23, 2014 (DE) ..... 10 2014 119 562

(51) Int. Cl.
*F04D 29/44* (2006.01)
*F04D 29/58* (2006.01)
(Continued)

(52) U.S. Cl.
CPC ..... *F04D 29/444* (2013.01); *F04D 27/0207* (2013.01); *F04D 29/5846* (2013.01);
(Continued)

(58) Field of Classification Search
CPC ..... F04D 29/444; F05D 2260/15; F05D 2260/606
See application file for complete search history.

(56) References Cited

U.S. PATENT DOCUMENTS 3,997,281 A * 12/1976 Atkinson ..... F04D 29/444 415/207
4,131,389 A 12/1978 Perrone et al.
(Continued)

FOREIGN PATENT DOCUMENTS

CN 1560479 A 1/2005
CN 101092976 A 12/2007
(Continued)

OTHER PUBLICATIONS

International Preliminary Report on Patentability, International Application No. PCT/EP2015/081037, dated Jun. 26, 2017, 6 pages.
(Continued)

*Primary Examiner* — Ninh H. Nguyen
(74) *Attorney, Agent, or Firm* — Barnes & Thornburg LLP

(57) ABSTRACT

The present disclosure relates to a diffuser for a radial compressor. The diffuser may comprise a diffusor duct portion formed by first and second side walls that are arranged so as to diverge at least partially from one another in a direction of flow, a blade ring having a number of blades arranged at least partially in the diffusor duct portion with each blade having a pressure side and a suction side delimited by a blade leading edge and by a blade trailing edge of the respective blade, a number of pressure equalizing openings incorporated into at least one of the first and second side walls of the diffuser duct portion in a region where the first and second side walls diverge from one another with each of the pressure equalizing openings being arranged between the pressure side of one blade and the suction side of an adjacent blade of the blade ring, and a first annular duct arranged behind the pressure equalizing openings and fluidically connected to the diffuser duct portion via at least two of the pressure equalizing openings, such that a number of regions
(Continued)

between two adjacent blades of the blade ring in the diffuser duct portion are fluidically connectable together.

14 Claims, 9 Drawing Sheets

(51) Int. Cl.
*F04D 29/68* (2006.01)
*F04D 27/02* (2006.01)

(52) U.S. Cl.
CPC ..... *F04D 29/681* (2013.01); *F05D 2220/40* (2013.01); *F05D 2260/15* (2013.01); *F05D 2260/606* (2013.01); *F05D 2260/607* (2013.01)

(56) References Cited

U.S. PATENT DOCUMENTS

| | | | | |
|---|---|---|---|---|
| 4,164,845 | A | 8/1979 | Exley et al. | |
| 4,368,005 | A * | 1/1983 | Exley | F01D 9/045 415/207 |
| 4,579,509 | A * | 4/1986 | Jacobi | F01D 17/143 415/199.1 |
| 5,427,498 | A * | 6/1995 | Lehe | F04D 29/167 415/106 |
| 6,168,375 | B1 | 1/2001 | LaRue et al. | |
| 7,845,900 | B2 | 12/2010 | Roduner et al. | |
| 8,235,648 | B2 * | 8/2012 | LeBlanc | F02C 3/08 415/57.1 |

FOREIGN PATENT DOCUMENTS

| | | | |
|---|---|---|---|
| DE | 102008044505 | A1 | 3/2010 |
| GB | 2041149 | A | 9/1980 |
| WO | 2000019107 | A1 | 4/2000 |
| WO | 2007098363 | A1 | 8/2007 |
| WO | 2012116880 | A1 | 9/2012 |
| WO | 2014087690 | A1 | 6/2014 |

OTHER PUBLICATIONS

International Written Opinion issued in connection with International Application No. PCT/EP2015/081037, dated Apr. 13, 2016, 6 pages.
International Search Report issued in connection with International Application No. PCT/EP2015/081037, dated Apr. 13, 2016, 2 pages.
International Report on Patentability issued in connection International Application No. PCT/EP2015/081037, dated Apr. 13, 2016, 10 pages.
Chinese Search Report for Chinese App. No. 201580070803.7, dated Oct. 24, 2018, 2 pages.
First Chinese Office Action for Chinese App. No. 201580070803.7, dated Nov. 2, 2018, 6 pages.
Second Chinese Office Action for Chinese App. No. 201580070803.7, dated Jun. 3, 2019, 8 pages.

* cited by examiner

DIFFUSER FOR A RADIAL COMPRESSOR

CROSS-REFERENCE TO RELATED APPLICATIONS

This application is a continuation of PCT International Patent Application No. PCT/EP2015/081037, filed on Dec. 22, 2015, which claims the benefit of German Patent Application No. 102014119558.2, filed on Dec. 23, 2014, and of German Patent Application No. 102014119562.0, filed on Dec. 23, 2014. The entire disclosures of the foregoing applications are expressly incorporated herein by reference.

TECHNICAL FIELD

The present disclosure relates to a diffuser for a radial compressor. In the following text, the term "radial compressor" also covers what are known as mixed-flow compressors having axial flow into and radial flow out of the compressor impeller. The field of application of the present disclosure also extends to compressors with purely radial or diagonal flow into or out of the compressor impeller. Furthermore, the present disclosure relates to a diffuser for a radial compressor usable in a turbocharger, wherein the turbocharger can have an axial turbine, a radial turbine, or a mixed-flow turbine.

BACKGROUND

In a radial compressor, a fluid (e.g. air) is first of all drawn in axially via a compressor wheel connected upstream of a diffuser and is accelerated and pre-compressed in the compressor wheel. In this process, energy in the form of pressure, temperature, and kinetic energy is supplied to the fluid. At the outlet of the compressor wheel, high flow rates prevail. The accelerated, pre-compressed air leaves the compressor wheel tangentially in the direction of the diffuser. In the diffuser, the kinetic energy of the accelerated air is converted into pressure. This takes place by deceleration of the flow in the diffuser. Through radial expansion, the flow cross-section of the diffuser is enlarged. The fluid is thus decelerated and pressure is built up. In order to achieve pressure ratios that are as high as possible in a turbocharger with a radial compressor, the diffusers that are used therein can be provided with a blading. An example of a bladed diffuser is shown by German Patent Application Publication No. 102008044505 A1 (the entire disclosure of which is incorporated by reference herein). The diffusers with blading that are known from the prior art are generally configured as radial parallel-walled diffusers with blading, as shown for example in U.S. Pat. No. 4,131,389 (the entire disclosure of which is incorporated by reference herein). In order to achieve a greater compressor efficiency at a given overall pressure ratio, the flow in the diffuser can be decelerated more greatly. The flow rates in the spiral are reduced as a result, with the result that the wall friction losses decrease and the efficiency of the compressor stage is improved. The use of diffusers with radial side-wall divergence allows greater deceleration with the same overall length compared with parallel-walled diffusers.

However, the deceleration or pressure increase that is achievable in the diffuser by geometric variation for a given operating point is limited, since flow instabilities arise in the diffuser on account of boundary layer separation in the event of excessive deceleration. The limits of the stable operating range of the diffuser thus determine the position of the surge line of the compressor in the compressor characteristic map.

If, instead of a parallel-walled diffuser, a diffuser with side-wall divergence is used—such a diffuser is described for example in PCT International Publication No. WO 2012/116880 A1 (the entire disclosure of which is incorporated by reference herein)—although the efficiency increases with identical compressor pressure ratios, at the same time the surge line moves toward greater mass flows at a given compressor pressure ratio compared with the compressor with a parallel-walled diffuser. This effect is not desired. The width of the compressor characteristic map is thereby reduced, and the usability of the compressor stage for applications in a turbocharger is thereby limited. One solution is to fluidically connect a diffuser duct portion of a bladed diffuser to an annular duct via pressure equalizing openings in order to allow pressure equalization between individual diffuser passages of the diffuser which are formed by adjacent diffuser blades. However, in this solution using pressure equalizing openings, the problem of the annular duct and/or the individual pressure equalizing openings becoming clogged can arise (e.g. on account of residues and deposits from compressor cleaning or by particles which are found in oil-containing intake air). This has a negative effect on the surge line of the compressor and, in extreme cases, can result in an engine connected to the diffuser no longer being able to be operated.

SUMMARY

One object of the present disclosure is developing a bladed diffuser having radial side-wall divergence for a radial compressor where the efficiency compared with parallel-walled diffusers is improved and, at the same time, the flow in the diffuser is stabilized, in order to improve the pumping behavior of the compressor. A further object of the present disclosure is to avoid or reduce premature boundary layer separation at the diffuser blades and at the side walls of the diffuser in individual diffuser passages as a result of excessive deceleration. Furthermore, another object of the present disclosure is to ensure that the operation of the diffuser is not impaired even in the case of possible contamination on account of deposits and residues from oil-containing intake air from the compressor. These and other objects may be achieved by the features of the diffusers described and claimed in the present disclosure.

In particular, the foregoing objects (among others) may be achieved by a diffuser for a radial compressor, wherein the diffuser comprises a diffuser duct portion which is formed by a first side wall and a second side wall, wherein the first side wall and the second side wall are arranged so as to diverge at least partially from one another in a direction of flow. Furthermore, the diffuser may comprise a blade ring having a number of blades, wherein the blades are arranged at least partially in the diffuser duct portion, wherein each of the blades has a pressure side and a suction side, and wherein the pressure side and the suction side of each blade are delimited by a blade leading edge and by a blade trailing edge of the respective blade. Furthermore, the diffuser may comprise a number of pressure equalizing openings which are incorporated into at least one of the first and second side walls of the diffuser duct portion in a region where the first and second side walls diverge from one another, wherein each of the pressure equalizing openings is arranged between the pressure side of one blade and the suction side of an adjacent blade of the blade ring. Furthermore, the diffuser may comprise a first annular duct, which is arranged behind the pressure equalizing openings, wherein the first annular duct is fluidically connected to the diffuser duct portion via at least two of the pressure equalizing openings, such that a number of diffuser passages of the diffuser are fluidically connectable together, each diffuser passage being a region between two adjacent blades of the blade ring in the diffuser duct portion.

One basic concept underlying the present disclosure is that, in a diffuser having side-wall divergence, the bladed diffuser duct portion of the diffuser may have pressure equalizing openings which are incorporated into at least one of the two side walls of the diffuser duct portion, wherein the diffuser duct portion of the diffuser is fluidically connected to a first annular duct and wherein the first annular duct is connectable to a pressure plenum via a connecting duct, such that a fluid can flow from the pressure plenum into the first annular duct in order that the first annular duct is flushed with the fluid.

This entails the advantage that, via the fluid in the form of a flushing medium which flows from the pressure plenum into the first annular duct in order to flush the annular duct with fluid, possible deposits and residues from coking by oil-containing intake air, which could clog the annular duct and the pressure equalizing openings, are flushed from the annular duct and thus also from the pressure equalizing openings. In this way, it is possible to prevent the pressure equalizing openings from being closed by deposits and the volume of the annular duct being greatly reduced.

A further advantage of the present disclosure is that pressure equalization can take place in the annular duct, thus counteracting flow separation at the diffuser blades in the bladed diffuser duct portion on account of excessive flow deceleration and thus neutralizing flow separation.

A further advantage of the present disclosure is that, as a result of the pressure equalization which takes place in the annular duct, pressure equalization also takes place at the same time between the individual passages of the diffuser in the diffuser duct portion, this in turn resulting in a reduction in the irregular loading of individual diffuser passages in the diffuser duct portion. A "diffuser passage" is defined here as being a space or a portion between two adjacent diffuser blades. Irregular loading of individual diffuser passages in the diffuser duct portion arises, by way of example, on account of asymmetries of the compressor housing and air intake port of the compressor, and the non-rotationally symmetrical pressure field brought about thereby, in the outflow region of the diffuser, on account of manufacturing and installation tolerances, and on account of transient flow effects. Pressure equalization makes it possible to neutralize incipient instabilities in individual diffuser passages, in that the stability reserves of other diffuser passages that are still running in a stable manner are used. As a result, the stable working range of the diffuser, and of the compressor, is expanded overall until all of the diffuser passages pass into the region of unstable flow. One consequence of this is that the surge line of the compressor is displaced toward smaller volume flows and enlarges the usable region of the compressor characteristic map.

In one embodiment according to the present disclosure, the pressure plenum is connected to a fluid source, wherein the fluid source is configured to provide fluid for the pressure plenum.

In one embodiment according to the present disclosure, the fluid source is configured as a charge air cooler, wherein the charge air cooler is configured to provide fluid, and wherein the fluid is introducible into the pressure plenum from the charge air cooler. Here, it should be noted that the fluid from the charge air cooler, which is in the form, for example, of flushing medium, is also or additionally usable for cooling a compressor wheel of the radial compressor.

In one embodiment according to the present disclosure, a filter system for cleaning the fluid is installed between the pressure plenum and the fluid source.

In one embodiment according to the present disclosure, a turbocharger arrangement is provided, which comprises a diffuser.

In one embodiment according to the present disclosure, the first annular duct is incorporated in one of the two side walls of the diffuser duct portion.

In one embodiment according to the present disclosure, the number of pressure equalizing openings which are incorporated into at least one of the two side walls of the diffuser duct portion are arranged in a region of the respective side wall in which the first side wall and second side wall are arranged so as to diverge at least partially from one another in the direction of flow.

In one embodiment according to the present disclosure, the pressure equalizing openings are each configured as one of a bore and a slot. Alternatively, a pressure equalizing opening could also be formed from several individual bores or slots.

In one embodiment according to the present disclosure, the orientation of each of the pressure equalizing openings in the respective side wall of the diffuser duct portion is determined by a setting angle, which is defined as the setting angle of the respective pressure equalizing opening to that face of the respective side wall that faces the diffuser duct portion.

In one embodiment according to the present disclosure, the first annular duct is subdivided by separating means into a number of individual, mutually separate duct sub-regions of the first annular duct. In this way, pressure equalization between diffuser passages within a duct sub-region can be locally limited.

In one embodiment according to the present disclosure, each duct sub-region of the first annular duct comprises at least two pressure equalizing openings. Here, it should generally be noted, however, that the pressure equalizing openings do not have to be an integral constituent of the annular duct.

In one embodiment according to the present disclosure, at least one second annular duct is incorporated in one of the side walls with pressure equalizing openings of the diffuser duct portion, such that the diffuser passages of two nonadjacent blades of the blade ring are fluidically connectable together.

In one embodiment according to the present disclosure, the first or second side wall of the diffuser duct portion is configured as a diffuser plate, wherein the number of pressure equalizing openings and at least one annular duct are incorporated in the diffuser plate.

One embodiment of the present disclosure comprises a radial compressor having a diffuser.

BRIEF DESCRIPTION OF THE DRAWINGS

A diffuser according to the present disclosure is described in the following text by way of exemplary embodiments which are explained in more detail by way of drawings, in which.

Figure 1:
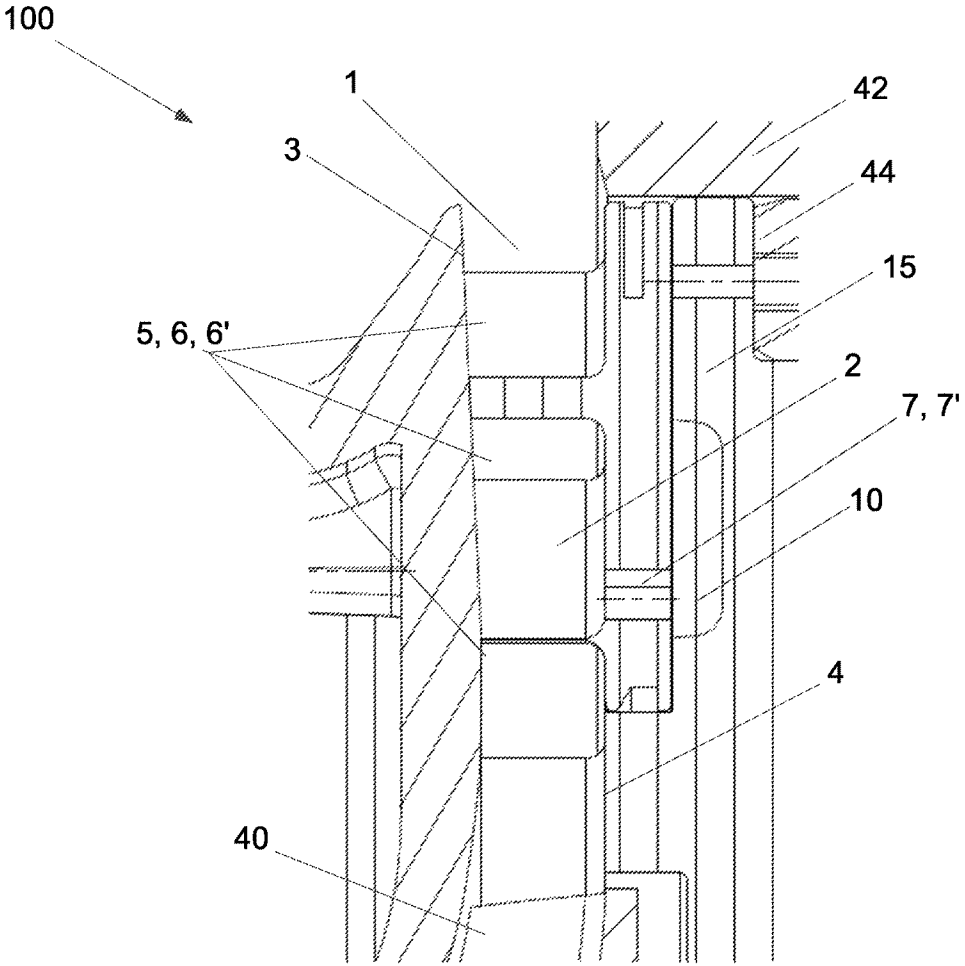
FIG. 1 shows a diffuser with blading for a radial compressor according to a first embodiment of the present disclosure.

In the following description, identical reference signs are used for similar and/or similarly acting parts:

1 Diffuser
2 Diffuser duct portion
3 First side wall
4 Second side wall
5 Blade ring
6, 6', 6", 6'" Blade of the blade ring
7, 7', 7", 7'", 7-1, 7-2 Pressure equalizing opening
8 Blade leading edge of a blade
8' Blade trailing edge of a blade
10 First annular duct
11, 11', 11" Duct sub-region
12 Diffuser plate
13 Separating means
15 Side wall
20 Second annular duct
22 Pressure side of a diffuser blade
23 Suction side of a diffuser blade
30 Connecting duct
31 Pressure plenum
35 Fluid source
39 Filter system
40 Compressor wheel
42 Compressor housing (turbine-side)
44 Bearing housing
52 Direction vector of the main direction of flow of the fluid in the diffuser duct portion
54 Setting angle
100 Radial compressor
101 Compressor wheel
150 Turbocharger arrangement
151 Turbine
153 Shaft
154 Compressor wheel cooling line

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives consistent with the present disclosure and appended claims.

In the following description, numerous specific details, such as types and interrelationships of system components, are set forth in order to provide a more thorough understanding of the present disclosure. It will be appreciated, however, by one skilled in the art that embodiments of the disclosure may be practiced without such specific details. Those of ordinary skill in the art, with the included descriptions, will be able to implement appropriate functionality without undue experimentation.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

FIG. 1 shows a diffuser 1 with blading for a radial compressor 100 according to a first embodiment of the present disclosure. The diffuser 1 comprises a diffuser duct portion 2 which is formed by a first side wall 3 and a second side wall 4. The diffuser duct portion 2 extends from the compressor wheel to the inlet into the compressor spiral (not illustrated). The first side wall 3 and the second side wall 4 are arranged so as to diverge at least partially from one another in the direction of flow. In FIG. 1, the diffuser 1 comprises a blade ring 5 with a number of individual blades 6, 6', wherein the blades 6, 6' are arranged at least partially in the diffuser duct portion 2. This means that there can be both bladed and non-bladed regions within the diffuser duct portion 2 in the diffuser 1. In the embodiment in FIG. 1, a number of pressure equalizing openings 7, 7' are incorporated in the second side wall 4, wherein only one pressure equalizing opening 7, 7' is illustrated in the side view in FIG. 1. The second side wall 4 of the diffuser 1 is located on a side facing a turbine wheel (not illustrated) in the embodiment in FIG. 1, wherein the turbine wheel is a constituent of a turbocharger arrangement (this not being illustrated) which also comprises the radial compressor 100. The diffuser 1 comprises a first annular duct 10 which is arranged behind or downstream of the pressure equalizing openings 7, 7'. The first annular duct 10 is in this case configured as a substantially annular continuous duct which can also be referred to as an open duct. Pressure equalization thus takes place in the open duct around the entire circumference thereof. As a result of pressure equalization, the flow between the diffuser passages in the diffuser duct portion 2 is stabilized in that stability reserves of adjacent or nonadjacent diffuser passages can be used in order to stabilize the flow in individual diffuser passages which are already being operated in the unstable region. A space, region, or portion between two adjacent diffuser blades is denoted a "diffuser passage."

The first annular duct 10 can be integrated directly, as a constituent of the side wall 3, 4, into one or both of the side walls 3, 4, so long as the annular duct 10 is installed behind the pressure equalizing openings 7, 7'. However, embodiments in which a respective annular duct is installed in each of the side walls 3, 4 would also be possible, said annular duct being fluidically connected (not illustrated) to the diffuser duct portion 2 via pressure equalizing openings 7, 7'.

In the embodiment in FIG. 1, the first annular duct 10 is incorporated in a third side wall 15, wherein the third side wall 15 is arranged behind or downstream of the second side wall 4 of the diffuser duct portion 2, and wherein the pressure equalizing openings 7, 7' are incorporated in the second side wall 4. The third side wall 15 can in this case also be configured as an intermediate wall arranged between the compressor side and the turbine side of a turbocharger arrangement.

However, the annular duct 10 (and thus also the pressure equalizing openings 7, 7') could also be a constituent of the second side wall 4 or of the first side wall 3 of the diffuser duct portion 2 (this not being illustrated), and so the third side wall 15 could be dispensed with. The pressure equalizing openings 7, 7' and the first annular duct 10 would then be incorporated in a component manufactured in one piece, wherein one face of this component would form the first side wall 3 or the second side wall 4. In this embodiment, too, the annular duct 10 would be arranged behind the pressure equalizing openings 7, 7', however, so that the annular duct 10 is fluidically connected to the diffuser duct portion 2 via the pressure equalizing openings 7, 7' and with the result that, at the same time, the number of flow cross sections of the diffuser 1 are fluidically connected together. In the embodiment in FIG. 1, it is appropriate for the annular duct 10 to be fluidically connected to the diffuser duct portion 2 via at least two of the pressure equalizing openings 7, 7'.

Each of the pressure equalizing openings 7, 7' which are incorporated into at least one of the two side walls 3, 4 of the diffuser duct portion 2 are arranged, in the embodiment shown in FIG. 1, in a region of the respective side wall 3, 4 in which the first side wall 3 and the second side wall 4 are arranged so as to diverge at least partially from one another in the direction of flow. However, the pressure equalizing openings 7, 7' can also be arranged outside the region of the diffuser duct portion 2 in which the first side wall 3 and the second side wall 4 are arranged so as to diverge at least partially from one another in the direction of flow.

In this case, the pressure equalizing openings 7, 7' can each be configured as a bore and/or as a slot. Alternatively, however, a pressure equalizing opening could also be made up of a plurality of openings, i.e. for example of a plurality of individual bores or slots or a combination of both shapes. However, some other form of the pressure equalizing opening in the diffuser 1 could also be realizable. In FIG. 1, the pressure equalizing openings 7, 7' are additionally arranged in the bladed diffuser duct portion 2 of the diffuser 1. In this way, it is possible to achieve the advantage that flow separations in this region—the bladed diffuser region—such that excessive decelerations are neutralized. Alternatively or additionally, the pressure equalizing openings 7, 7' could also be arranged in a non-bladed diffuser duct portion 2, (e.g. a number of individual pressure equalizing openings 7, 7' could be incorporated into at least one of the two side walls 3, 4, with no diffuser blades 6, 6' arranged in this region of the diffuser duct portion 2, which is formed by the two side walls 3, 4). In the embodiment in FIG. 1, the radial compressor 100 having the diffuser 1 according to the present disclosure also comprises a compressor wheel 40, a compressor housing 42, and a bearing housing 44. Additional constituents of the compressor are not illustrated in the drawing(s) for reasons of clarity.

Figure 2:
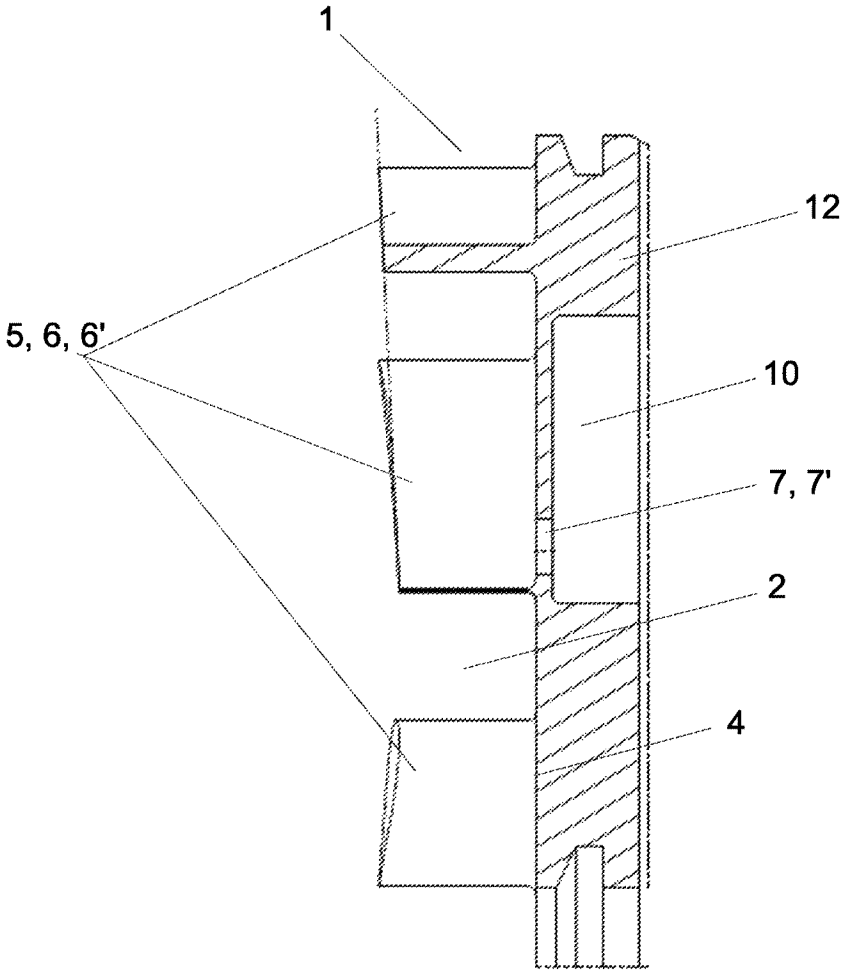
FIG. 2 shows a partial detail of a diffuser with blading for a radial compressor according to a second embodiment of the present disclosure.

FIG. 2 shows a profile view of a partial detail of a diffuser 1 with blading for a radial compressor 100 according to a second embodiment of the present disclosure. In this case, FIG. 2 shows a diffuser 1 which comprises, in the diffuser duct portion 2, a number of diffuser blades 6, 6' of the blade ring 5 (not fully illustrated in FIG. 2). In the view in FIG. 2, only the second side wall 4 of the diffuser 1 is illustrated. Pressure equalizing openings 7, 7' are incorporated in the second side wall 4, wherein only one pressure equalizing opening is illustrated in the profile view in FIG. 2. In the side wall 4, an annular duct 10 is arranged directly behind the pressure equalizing opening 7, 7'. The annular duct 10 is thus a constituent of the second side wall 4 in the embodiment shown in FIG. 2. The annular duct 10 allows pressure equalization between individual diffuser blades 6, 6' which are arranged at least partially within the side-wall-divergent diffuser duct portion 2. As a result, flow separation at the individual diffuser blades 6, 6' of the blade ring 5 of the diffuser 1 can be neutralized. Flow separations initially occur, on approaching the surge line of the diffuser 1, in individually highly loaded diffuser passages (e.g. in regions of two adjacent diffuser blades 6, 6' which, on account of asymmetries, for instance in the compressor housing, are irregularly loaded). The pressure equalizing opening 7, 7' illustrated in FIG. 2 connects the first annular duct 10 to the flow cross sections of the diffuser 1.

The second side wall 4 of the diffuser 1 is a constituent of a diffuser plate 12 in the embodiment of the diffuser 1 that is illustrated in FIG. 2. The diffuser plate 12 comprises the individual pressure equalizing openings 7, 7' and the first annular duct 10, wherein the first annular duct 10 is arranged behind the pressure equalizing openings 7, 7'.

Figure 3:
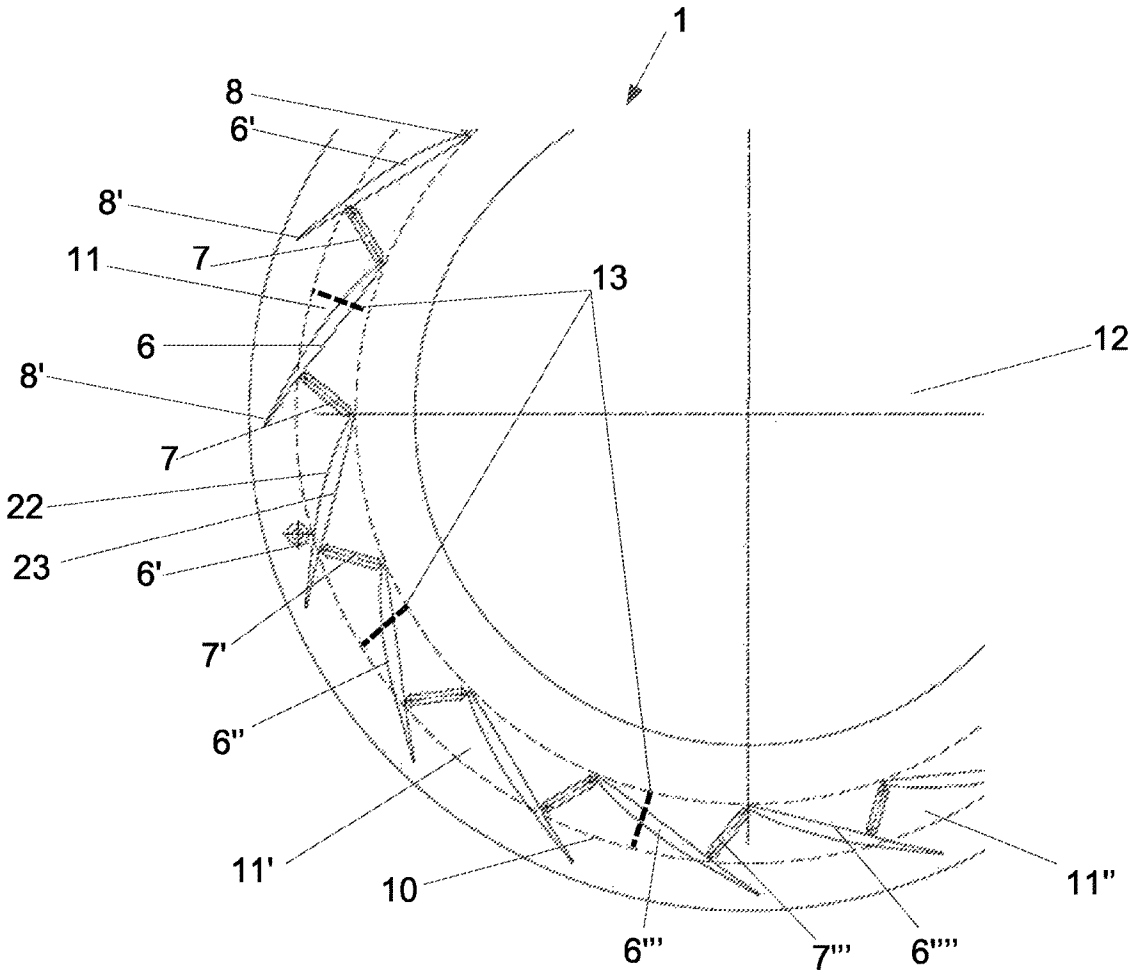
FIG. 3 shows a diffuser plate with pressure equalizing openings and with a number of mutually separate duct sub-regions according to a third embodiment of the present disclosure.

FIG. 3 shows a plan view of a diffuser 1. The diffuser 1 comprises a diffuser plate 12. The diffuser plate 12 comprises a number of pressure equalizing openings 7, 7', which each fluidically connect the flow cross sections of the diffuser 1 to a first annular duct 10. The first annular duct 10 is arranged behind the pressure equalizing openings 7, 7'. As shown in FIG. 3, the first annular duct 10 is configured as a continuous annular space. In this case, as already illustrated in FIGS. 1 and 2, the first annular duct 10 can either be integrated directly in the diffuser plate 12 or, alternatively, be incorporated in a separate wall, wherein the separate wall is arranged behind the diffuser plate 12. Each of the pressure equalizing openings 7, 7' of the diffuser plate 12 illustrated in FIG. 3 is arranged between two adjacent blades 6, 6'. Each of the blades 6, 6' comprises a pressure side 22 and a suction side 23, wherein the pressure side 22 and the suction side 23 of each blade 6, 6' are delimited by a blade leading edge 8 and by a blade trailing edge 8' of the respective blade 6, 6'. Thus, the blade 6' in FIG. 3 comprises for example a blade leading edge 8 and a blade trailing edge 8' which each delimit the pressure side 22 and the suction side 23 of this blade 6'. Each of the number of pressure equalizing openings 7, 7' is arranged between the pressure side 22 of one blade 6 and the suction side 23 of the adjacent blade 6' of the blade ring 5. Thus, for example, the pressure equalizing opening 7 located in the diffuser passage between the blade 6 and the blade 6' in FIG. 3 is arranged such that said pressure equalizing opening 7 is arranged between the pressure side 22 of the blade 6 and the suction side 23 of the adjacent blade 6' of the blade ring 5.

The individual pressure equalizing openings 7, 7' are configured as slots in FIG. 3. Alternatively, the individual pressure equalizing openings 7, 7' can each be configured as a bore and/or slot. However, it would be conceivable to also provide several bores or slots, which then each form a pressure equalizing opening 7, 7'.

In the embodiment of the diffuser 1 illustrated in FIG. 3, the first annular duct 10 is subdivided by separating means 13 into a number of individual, mutually separated duct sub-regions 11, 11'. Each of the duct sub-regions 11, 11' of the first annular duct 10 is assigned two diffuser passages in the embodiment illustrated. However, it should be clarified that the pressure equalizing openings 7, 7' are not an integral constituent of the first annular duct 10. As a result of the subdivision of the first annular duct 10 into individual duct sub-regions, pressure equalization takes place only between respectively adjacent blades 6, 6' of a duct sub-region 11, 11'. In this way, the pressure equalization between blades within a duct sub-region can be locally limited. As a result of the individual duct sub-regions, closed duct sub-regions arise. Thus, in the embodiment illustrated in FIG. 3, pressure equalization no longer takes place over the entire first annular duct 10, as is the case with a continuous annular duct in the embodiments in FIGS. 1 and 2. The separating means 13 can be configured, for example, as partition walls. The individual partition walls 13 are located in this case on the side of the diffuser 1 remote from the flow. The subdivision of the first annular duct 10 into individual duct sub-regions that are independent of one another in terms of flow can contribute to increased stability and an improvement in efficiency of the diffuser 1. The individual duct sub-regions 11, 11' within the first annular duct 10 can be produced, for example, by additive manufacturing methods. Alternatively, it would also be possible to subdivide the first annular duct 10 into individual duct sub-regions 11, 11' by abutment against an adjacent component, for example, a bearing housing of the radial compressor 100 (this not being illustrated).

Figure 4:
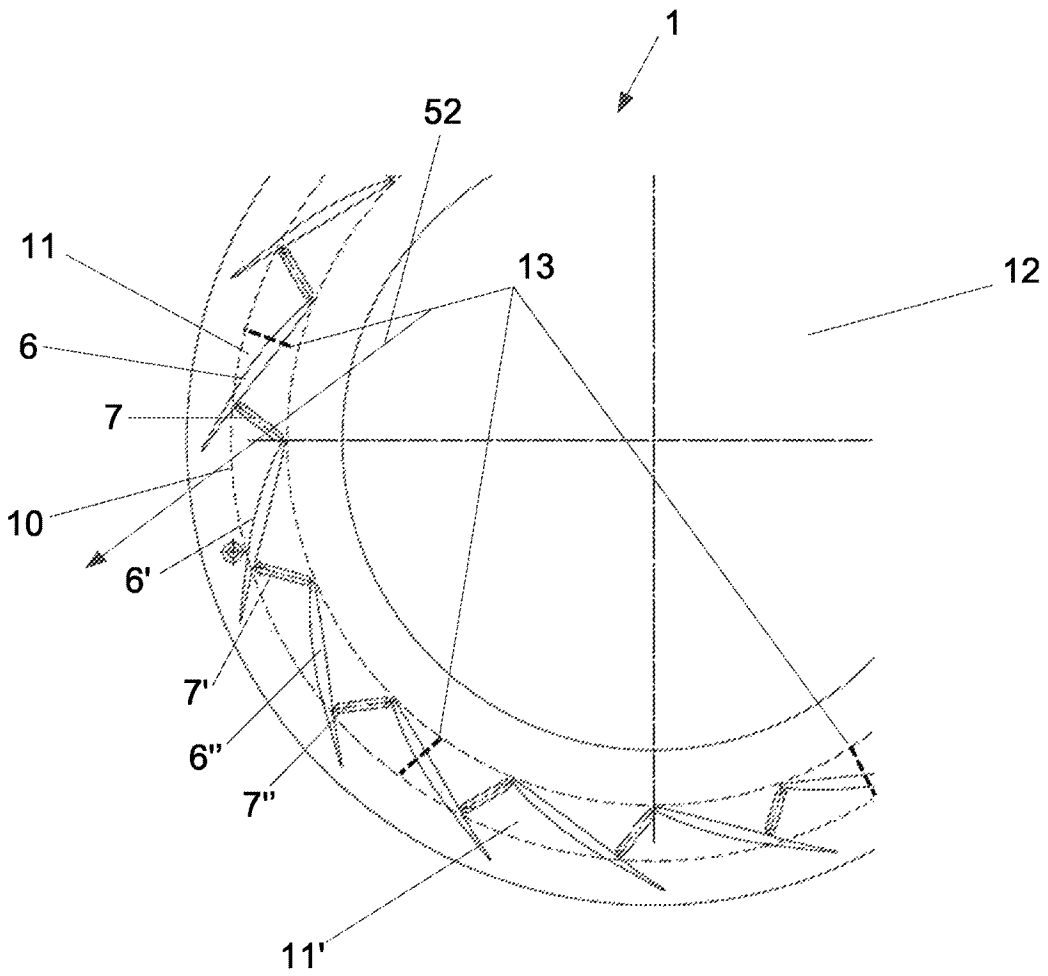
FIG. 4 shows a diffuser plate with pressure equalizing openings and with a number of mutually separate duct sub-regions according to a fourth embodiment of the present disclosure.

FIG. 4 shows a plan view of a further embodiment of the diffuser 1 according to the present disclosure. In this case, FIG. 4 shows the diffuser plate 12 of the diffuser 1. A number of pressure equalizing openings 7, 7', 7" are incorporated into the diffuser plate 12, which each fluidically connect the narrowest flow cross sections of the diffuser 1 to the annular duct 10, wherein the first annular duct 10 is arranged behind the pressure equalizing openings 7, 7', 7". The embodiment of the diffuser 1 that is illustrated in FIG. 4 differs from the embodiment shown in FIG. 3 in that each of the individual duct sub-regions 11, 11' comprises three pressure equalizing openings 7, 7', 7" with the three blades 6, 6', 6". For greater clarity, only the duct sub-region 11 of the first annular duct 10 is provided with corresponding reference signs in FIG. 4. Alternatively, embodiments are also realizable in which more than three blades share a duct sub-region of the first annular duct 10 by corresponding separation. It would also be conceivable for there to be duct sub-regions within the first annular duct 10 which each comprise a different number of blades, for example one duct sub-region which extends via two blades and one duct sub-region which comprises three blades. In the embodiment in FIG. 4, the main direction of flow of the fluid in a diffuser passage which is formed by the blade 6 and the blade 6' is also illustrated by way of example by the direction vector 52.

Figure 5:
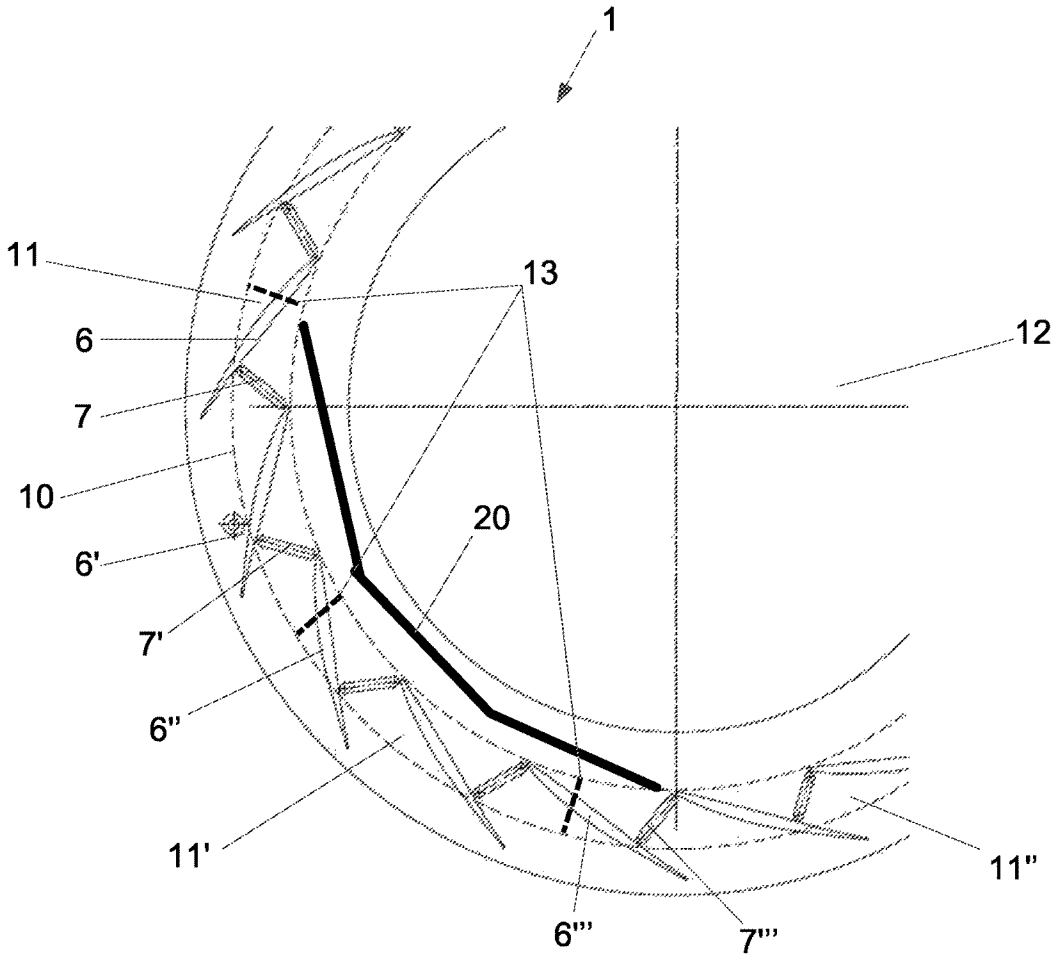
FIG. 5 shows a diffuser plate with pressure equalizing openings and a connection of nonadjacent diffuser passages according to a fifth embodiment of the present disclosure.

FIG. 5 shows a further embodiment of the diffuser 1 according to the present disclosure with a diffuser plate 12 of the diffuser 1 in plan view. The diffuser plate 12, illustrated in this embodiment of FIG. 5, is in principle identical to the embodiment of the diffuser 1 that is illustrated in FIG. 3. The embodiment in FIG. 5 differs from the embodiment in FIG. 3 only in that, in the diffuser plate 12 in FIG. 5, in addition to a first annular duct 10, a second annular duct 20 is provided. The second annular duct 20 in the diffuser plate 12 has the object here of fluidically connecting the diffuser passages of nonadjacent blades together. In the embodiment in FIG. 5, the annular duct 20 connects the blades of the duct sub-region 11 to the blades of the duct sub-region 11". In this way, pressure equalization between nonadjacent blades, which are each located in different duct sub-regions of the diffuser plate 1, can be realized. The second annular duct 20 can be incorporated in the diffuser plate 12 in which the first annular duct 10 is also incorporated. Alternatively, the second annular duct 20 can be incorporated in a separate wall which is arranged behind the diffuser plate 12 when the diffuser plate 12 has pressure equalizing openings. Alternatively, the second annular duct 20 can be incorporated in one of the side walls 3, 4 with pressure equalizing openings 7, 7' of the diffuser duct portion 2 or in the third side wall 15, which is located behind one of the side walls 3, 4 with pressure equalizing openings 7, 7'. In this way, it is possible for example for two diffuser passages to be fluidically connected together, wherein the two diffuser passages are not arranged directly alongside one another and adjacent. As illustrated in FIG. 5, this means that, for example, a diffuser passage which comprises the pressure equalizing opening 7 is fluidically connected to a diffuser passage which comprises the pressure equalizing opening 7'". In this way, pressure equalization between blades or of diffuser passages of nonadjacent duct sub-regions can take place. Depending on the application, it is also possible for more than two annular ducts to be incorporated in the diffuser 1.

Figure 6:
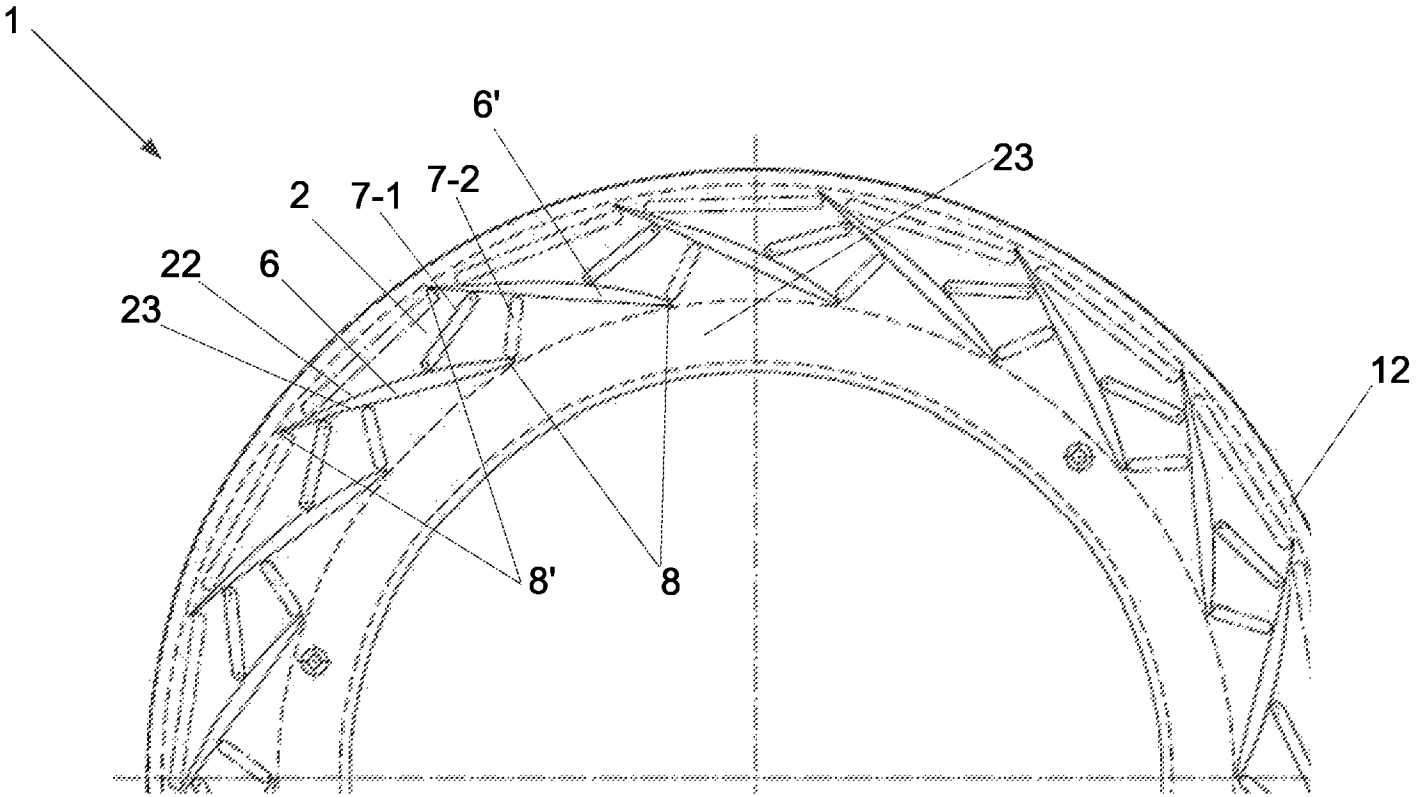
FIG. 6 shows a detail of a diffuser plate with examples of possible orientations of pressure equalizing openings between adjacent blades in a diffuser passage.

FIG. 6 shows a detail of a diffuser plate 12 with examples of possible orientations of pressure equalizing openings in a diffuser passage between two adjacent blades 6, 6'. The embodiment in FIG. 6 differs from the embodiments in FIGS. 3, 4, and 5 only in that the pressure equalizing openings 7-1 and 7-2 illustrated by way of example in FIG. 6 can each take up different orientations with respect to the diffuser plate 12, or positions, within a diffuser passage of two adjacent diffuser blades 6, 6'. Each of the blades 6, 6' in FIG. 6 comprises in each case a pressure side 22 and a suction side 23. The pressure side 22 and the suction side 23 of each blade 6, 6' are in this case delimited by a blade leading edge 8 and a blade trailing edge 8' of the respective blade 6, 6'. In FIG. 6, the pressure equalizing opening 7-1 located in the diffuser passage between the blade 6 and the blade 6' is arranged or oriented such that, for example, the pressure equalizing opening 7-1 is arranged between the pressure side 22 of the blade 6 and the suction side 23 of the adjacent blade 6' of the blade ring 5. The same goes for the arrangement of the pressure equalizing opening 7-2 illustrated in FIG. 6.

In the embodiment in FIG. 6, a pressure equalizing opening (i.e. either the pressure equalizing opening 7-1 or the pressure equalizing opening 7-2) is located in the diffuser passage between the mutually adjacent diffuser blades 6, 6'. However, it would also be possible for a plurality of pressure equalizing openings to be arranged within a diffuser passage, wherein the situation and the position of the plurality of pressure equalizing openings within the diffuser passage can be different from one another.

Figure 7:
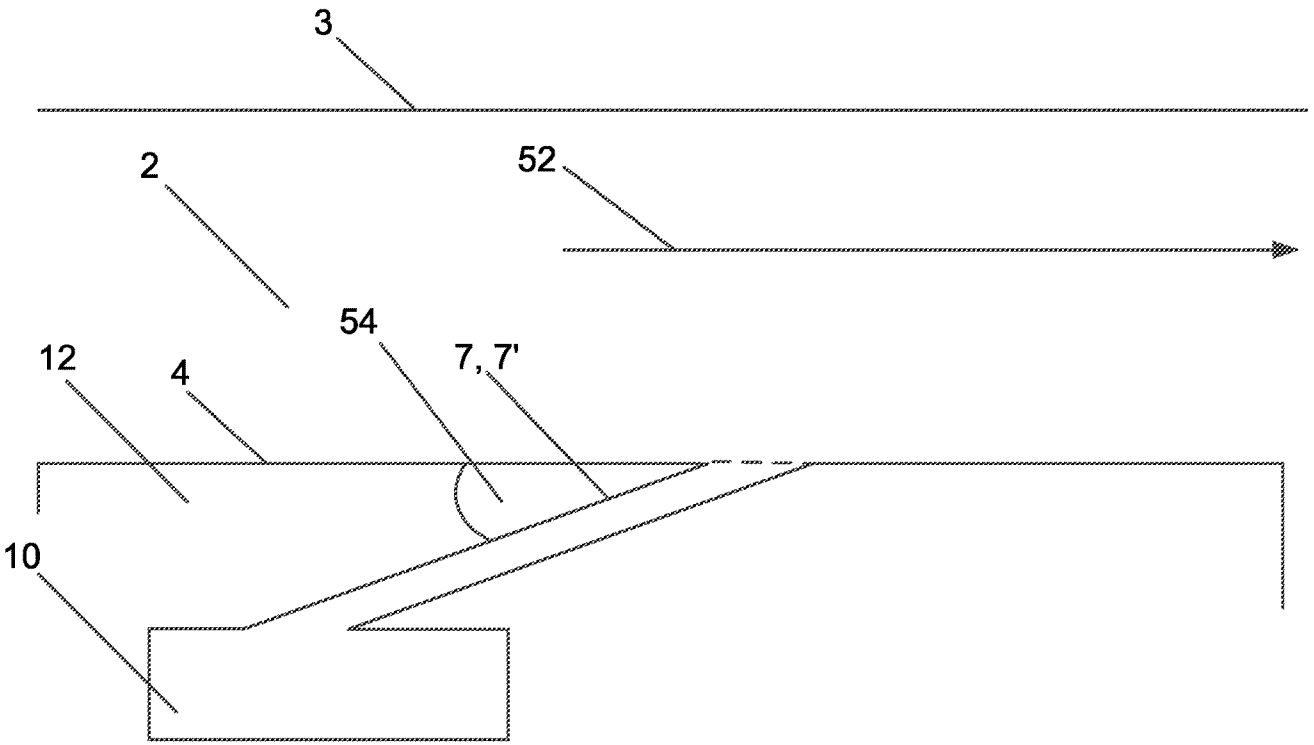
FIG. 7 shows an example of an orientation of a pressure equalizing opening in a diffuser plate.

FIG. 7 shows an example of an orientation or a possible situation of a pressure equalizing opening 7, 7' within a diffuser plate 12 and with regard to the main direction of flow 52 of the fluid in the diffuser duct portion 2. In FIG. 7, the diffuser duct portion is formed by the side wall 3 and the side wall 4, wherein the side wall 4 is a constituent of the diffuser plate 12. The pressure equalizing opening 7, 7' is incorporated in the diffuser plate 12 in the embodiment in FIG. 7 and is connected to the first annular duct 10. For illustration, in FIG. 7, the direction of flow of the fluid in the diffuser duct portion 2 is additionally shown, which is depicted by a vector 52. The orientation of the pressure equalizing opening 7, 7', illustrated in FIG. 7, which is incorporated in the side wall 4 of the diffuser duct portion 2 is determined by a setting angle 54 which is defined as the setting angle 54 of the pressure equalizing opening 7, 7' to that face of this side wall 4 that faces the diffuser duct portion 2. In this case, the setting angle 54 in the embodiment in FIG. 7 can preferably be in a range between greater than 0 degrees and approximately less than 180 degrees, in order to reduce fluid losses in the diffuser duct portion 2.

Figure 8:
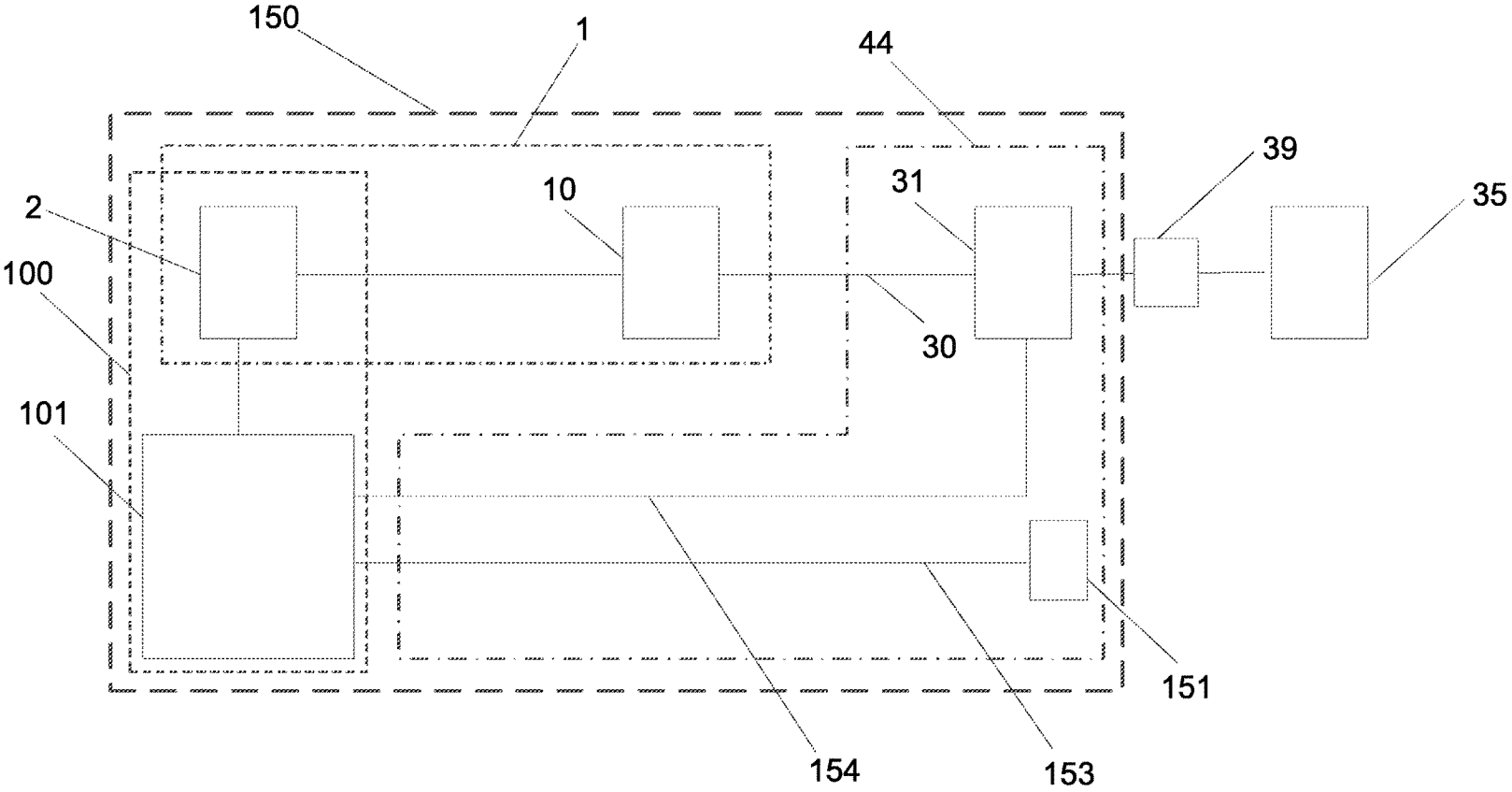
FIG. 8 shows a bladed diffuser for a radial compressor with an annular duct and pressure plenum for a radial compressor for use in a turbocharger arrangement according to a sixth embodiment of the present disclosure.

FIG. 8 shows a schematic depiction of a turbocharger arrangement 150 with a bladed diffuser 2. In the embodiment in FIG. 8, the turbocharger arrangement 150 comprises a diffuser 2 which is fluidically connected to a first annular duct 10 via pressure equalizing openings 7, 7' (not illustrated). The diffuser 2 is connected to a compressor wheel 101, wherein the compressor wheel 101 is driven by a turbine 151 via a shaft 153. The diffuser 2 and the compressor wheel 101 are constituents of a radial compressor 100. The first annular duct 10 is connected to a pressure plenum 31, which is also referred to as annular duct plenum, via a connecting duct 30. A fluid is passed as flushing agent or flushing medium into the pressure plenum 31, said fluid preferably being in the form of flushing air but also or additionally being usable for cooling. The fluid is provided by a fluid source 35 in the embodiment in FIG. 8. This fluid source 35, which can also be referred to as pressure source, can preferably be configured as a charge air cooler. The charge air cooler is fed with compressed air by the radial compressor 100 and cools the compressed air of the radial compressor 100 to a particular temperature before it is supplied to an engine (this not being illustrated). The fluid in the form of a flushing agent from the charge air cooler is then supplied to the pressure plenum 31. The pressure plenum 31 is additionally connected to the compressor wheel 101 via a duct 154 in the embodiment illustrated in FIG. 8, such that a part of the flushing agent from the charge air cooler 35 can also be used for cooling the compressor wheel 101. In this way, compressor wheel cooling can be realized. The first annular duct 10 is flushed with the flushing agent from the fluid source 35, wherein the flushing agent is able to be stored in the pressure plenum 31. The connecting duct 30 is preferably configured as a bore with a defined diameter. However, the connecting duct 30 does not necessarily have to be configured as a bore with a particular diameter, but can also be configured as a polygonal passage or a passage with some other shape. Alternatively, the connecting duct 30 can also be formed from a number of individual passages. The geometric design of the connecting duct 30 determines the pressure at which the flushing agent is passed through the connecting duct 30 into the first annular duct 10.

The pressure in the first annular duct 10 should be minimally higher in terms of value than a pressure which is formed in the diffuser duct portion 2, in order that intended pressure equalization in the first annular duct 10 is not impaired. Furthermore, a situation should be avoided in which a large amount of air is blown out of the first annular duct 10 into the diffuser duct portion 2. As a result of the geometric design of the connecting duct 30, the pressure at which the flushing agent is transported in the connecting duct 30 to the first annular duct 10 can be set. As a result of the flushing agent conveyed into the first annular duct 10 at a determined, set pressure, the first annular duct 10 is flushed with flushing agent. Flushing prevents soiling of the first annular duct 10 and clogging of the pressure equalizing openings 7, 7', 7", 7'" by deposits of oil-containing particles, as can be contained in the air from the diffuser duct portion 2. In order that the flushing medium can be introduced into the first annular duct 10 at a defined pressure, a defined pressure should already be formed in the fluid source 35 and in the pressure plenum 31, said defined pressure being greater in terms of value than a pressure in the first annular duct 10 and a pressure in the diffuser 2. The pressure in the fluid source 35 should in this case be greater in terms of value than a pressure in the pressure plenum 31 and a pressure in the annular duct 10 and a pressure in the diffuser duct portion 2. The fluid source 35 can in this case also be configured as a compressed air network. The fluid source 35 can in this case also comprise a plurality of fluid sources which provide fluid for the pressure plenum 31. In addition, in the embodiment in FIGS. 8 and 9, a filter system 39 can be provided which is installed between the pressure plenum 31 and the fluid source 35 in order to clean the flushing agent or fluid. Very generally, provision can also be made for it to be possible to use the fluid from the fluid source 35 in order, in addition to the first annular duct 10, also to flush a second annular duct when a corresponding connection is established between the pressure plenum 31 and the second annular duct (this not being illustrated).

Figure 9:
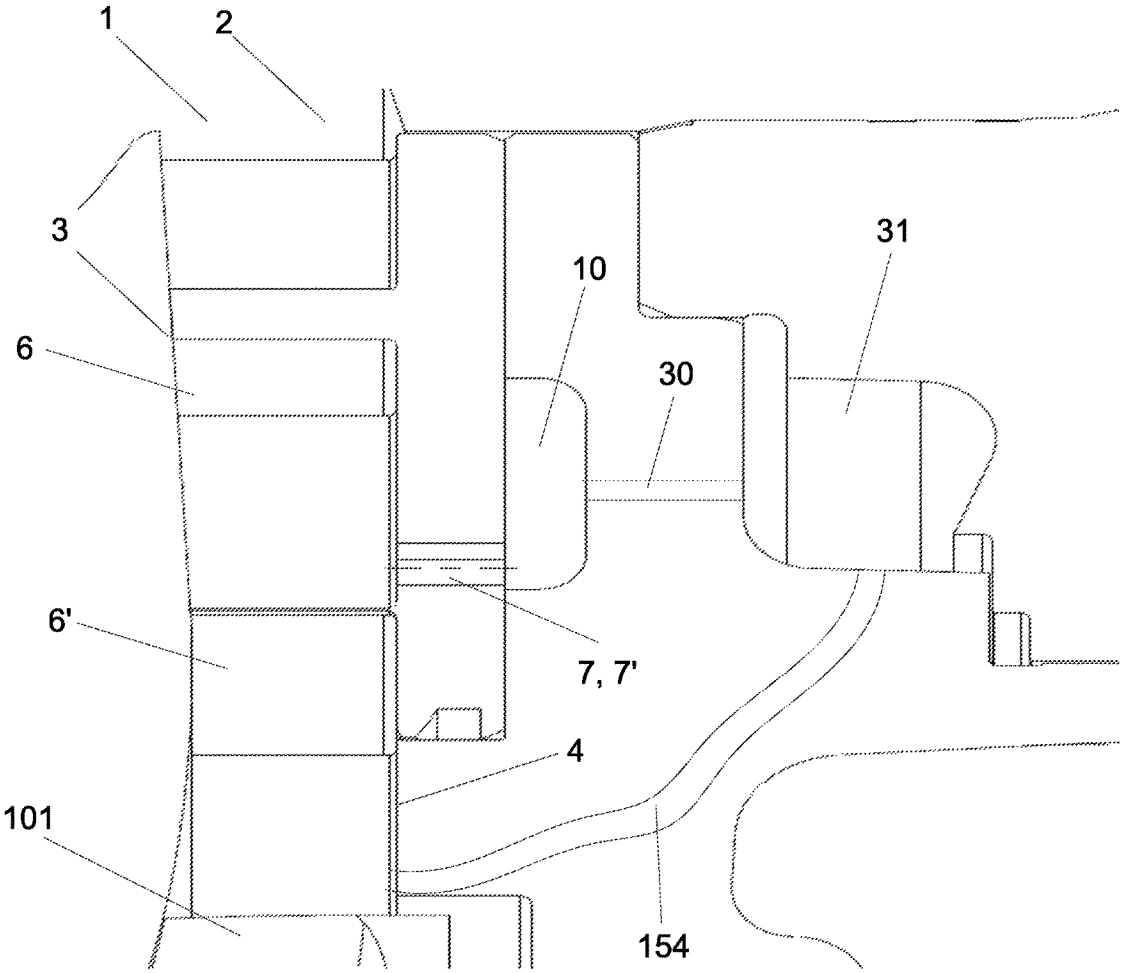
FIG. 9 shows an alternative schematic depiction of a bladed diffuser with an annular duct and pressure plenum for a radial compressor according to a seventh embodiment of the present disclosure.

FIG. 9 shows a diffuser 2 with blading and a pressure plenum 31 for a radial compressor. The embodiment in FIG. 9 differs from the embodiment in FIG. 1 in that the first annular duct 10 is connected to a pressure plenum 31 via a connecting duct 30. As already explained with regard to the embodiment in FIG. 8, a fluid under pressure is introduced into the first annular duct 10 from the pressure plenum 31, which is connected to the fluid source 35, via the connecting duct 30. This achieves the effect that the first annular duct 10 is flushed with the flushing agent, in the form of fluid, from the fluid source 35 in order to detach or to prevent deposits and particle residues in the annular duct 10 and in the pressure equalizing openings 7, 7', 7", 7'". A further difference from the embodiment in FIG. 1 is that, in addition, compressor wheel cooling for cooling the compressor wheel 101 is realized in that the fluid is passed from the pressure plenum 31 to the compressor wheel 101 via a connecting duct 154.

While certain illustrative embodiments have been described in detail in the drawings and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the systems, apparatus, and methods described herein. It will be noted that alternative embodiments of the systems, apparatus, and methods of the present disclosure may not include all of the features described yet still benefit from at least some of the advantages of such features. Those of ordinary skill in the art may readily devise their own implementations of systems, apparatus, and methods that incorporate one or more of the features of the present disclosure and fall within the spirit and scope of the present disclosure.

The invention claimed is:

1. A diffuser for a radial compressor, the diffuser comprising:

a diffuser duct portion which is formed by a first side wall and a second side wall, wherein the first side wall and the second side wall are arranged so as to diverge at least partially from one another in a direction of flow;

a blade ring having a number of blades, wherein the blades are arranged at least partially in the diffuser duct portion, wherein each of the blades has a pressure side and a suction side, and wherein the pressure side and the suction side of each blade are delimited by a blade leading edge and by a blade trailing edge of the respective blade;

a number of pressure equalizing openings which are incorporated into at least one of the first and second side walls of the diffuser duct portion in a region where the first and second side walls diverge from one another, wherein each of the pressure equalizing openings is arranged between the pressure side of one blade and the suction side of an adjacent blade of the blade ring; and a first annular duct, which is arranged behind the pressure equalizing openings, wherein the first annular duct is fluidically connected to the diffuser duct portion via at least two of the pressure equalizing openings, such that a number of diffuser passages of the diffuser are fluidically connectable together, each diffuser passage being a region between two adjacent blades of the blade ring in the diffuser duct portion.

2. The diffuser of claim 1, wherein the first annular duct is incorporated in one of the first and second side walls of the diffuser duct portion.

3. The diffuser of claim 1, wherein the pressure equalizing openings are each configured as one of a bore and a slot.

4. The diffuser of claim 1, wherein an orientation of each of the pressure equalizing openings in the respective side wall of the diffuser duct portion is determined by a setting angle between the respective pressure equalizing opening and a face of the respective side wall that faces the diffuser duct portion.

5. The diffuser of claim 1, wherein the first annular duct is subdivided into a number of individual, mutually separate duct sub-regions.

6. The diffuser of claim 5, wherein each duct sub-region of the first annular duct comprises at least two pressure equalizing openings.

7. The diffuser of claim 1, further comprising at least one second annular duct incorporated in one of the first and second side walls with pressure equalizing openings of the diffuser duct portion, such that the diffuser passages of two nonadjacent blades of the blade ring are fluidically connectable together.

8. The diffuser of claim 1, wherein the first or second side wall of the diffuser duct portion is configured as a diffuser plate, and wherein the pressure equalizing openings and the first annular duct are incorporated in the diffuser plate.

9. The diffuser of claim 1, wherein the first annular duct is connectable to a pressure plenum via a connecting duct, such that a fluid can flow from the pressure plenum into the first annular duct to flush the first annular duct with the fluid.

10. The diffuser of claim 9, wherein the pressure plenum is connected to a fluid source, and wherein the fluid source is configured to provide fluid for the pressure plenum.

11. The diffuser of claim 10, wherein the fluid source is configured as a charge air cooler, wherein the charge air cooler is configured to provide fluid, and wherein the fluid is introducible into the pressure plenum from the charge air cooler.

12. The diffuser of claim 10, wherein a filter system for cleaning the fluid is installed between the pressure plenum and the fluid source.

13. A radial compressor comprising a diffuser, the diffuser comprising:

a diffuser duct portion which is formed by a first side wall and a second side wall, wherein the first side wall and the second side wall are arranged so as to diverge at least partially from one another in a direction of flow;

a blade ring having a number of blades, wherein the blades are arranged at least partially in the diffuser duct portion, wherein each of the blades has a pressure side and a suction side, and wherein the pressure side and the suction side of each blade are delimited by a blade leading edge and by a blade trailing edge of the respective blade;

a number of pressure equalizing openings which are incorporated into at least one of the first and second side walls of the diffuser duct portion in a region where the first and second side walls diverge from one another, wherein each of the pressure equalizing openings is arranged between the pressure side of one blade and the suction side of an adjacent blade of the blade ring; and a first annular duct, which is arranged behind the pressure equalizing openings, wherein the first annular duct is fluidically connected to the diffuser duct portion via at least two of the pressure equalizing openings, such that a number of diffuser passages of the diffuser are fluidically connectable together, each diffuser passage being a region between two adjacent blades of the blade ring in the diffuser duct portion.

14. A turbocharger comprising a radial compressor, the radial compressor comprising a diffuser, the diffuser comprising:

a diffuser duct portion which is formed by a first side wall and a second side wall, wherein the first side wall and the second side wall are arranged so as to diverge at least partially from one another in a direction of flow;

a blade ring having a number of blades, wherein the blades are arranged at least partially in the diffuser duct portion, wherein each of the blades has a pressure side and a suction side, and wherein the pressure side and the suction side of each blade are delimited by a blade leading edge and by a blade trailing edge of the respective blade;

a number of pressure equalizing openings which are incorporated into at least one of the first and second side walls of the diffuser duct portion in a region where the first and second side walls diverge from one another, wherein each of the pressure equalizing openings is arranged between the pressure side of one blade and the suction side of an adjacent blade of the blade ring; and a first annular duct, which is arranged behind the pressure equalizing openings, wherein the first annular duct is fluidically connected to the diffuser duct portion via at least two of the pressure equalizing openings, such that a number of diffuser passages of the diffuser are fluidically connectable together, each diffuser passage being a region between two adjacent blades of the blade ring in the diffuser duct portion.

* * * * *